US005248254A

United States Patent [19]

Ellringmann

[11] Patent Number: 5,248,254

[45] Date of Patent: Sep. 28, 1993

[54] FURNACE FOR THE HEAT TREATMENT OF INDIVIDUAL PARTS

[75] Inventor: Kurt Ellringmann, Bad Iburg, Fed. Rep. of Germany

[73] Assignee: Maerz Ofenbau GmbH, Dusseldorf, Fed. Rep. of Germany

[21] Appl. No.: 897,398

[22] Filed: Jun. 12, 1992

[30] Foreign Application Priority Data

Jun. 14, 1991 [DE] Fed. Rep. of Germany ..... 4119709

[51] Int. Cl.[5] ..... F27B 9/14

[52] U.S. Cl. ..... 432/241; 272/34; 272/201; 414/198

[58] Field of Search ..... 432/122, 123, 242; 414/156, 173, 198, 525.9; 277/34, 34.3, 201

[56] References Cited

U.S. PATENT DOCUMENTS

| | | | |
|---|---|---|---|
| 4,330,262 | 5/1982 | Kranzl et al. | 432/122 X |
| 4,556,385 | 12/1985 | Denis | 432/122 |
| 4,741,695 | 5/1988 | Ushijima | 432/122 X |
| 4,820,150 | 4/1989 | Ushijima | 432/122 X |

*Primary Examiner*—William E. Tapolcai
*Attorney, Agent, or Firm*—Staas & Halsey

[57] ABSTRACT

A furnace for the heat treatment of individual parts, in particular metal sheeting, which has a transport apparatus for conveying the parts to be treated through the furnace. This transport apparatus has two groups of longitudinal beams for supporting the parts, the beams lying alternatively adjacent one another in spaced relationship and at least one beam group of which being movable forwardly into a higher position than the other beam group along a partial stretch of the transport route and subsequently being movable back into its initial position into a lower position than this other beam group. A support structure supporting the beam and movable therewith is provided beneath each longitudinal beam, the support structure having at least one side surface extending continuously over the entire length of the supporting structure and facing the support structure of the adjacent longitudinal beam. In accordance with the invention, a tube is provided between two neighbouring support structures which also extends over the entire length of the support structures, the tube being expandable in cross section by filling this with a pneumatic or hydraulic pressurized substance and thus being able to be brought into tight engagement with the said side surface.

11 Claims, 2 Drawing Sheets

FURNACE FOR THE HEAT TREATMENT OF INDIVIDUAL PARTS

Figure 1:
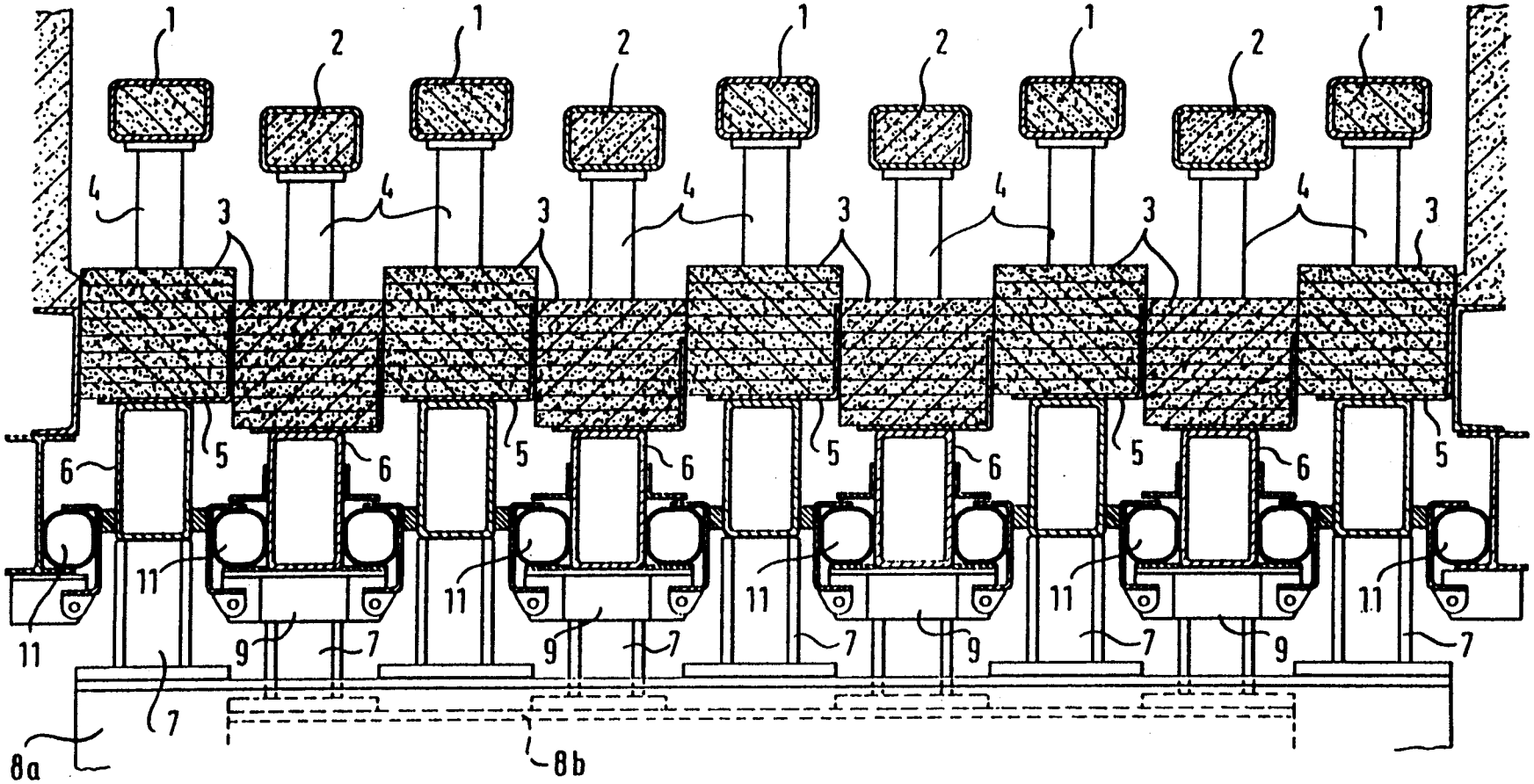

The invention relates to a furnace for the heat treatment of individual parts, for example metal sheeting, comprising a transport apparatus for conveying the parts to be treated through the furnace. This transport apparatus has two groups of longitudinal beams for supporting the parts, the beams being alternatively arranged in spaced relationship to one another and at least one of these beam groups being movable forwardly into a position higher than the other beam group over a partial stretch of the transport route through the furnace and being subsequently movable back into its initial position into a lower position than the other beam group. A support structure is provided beneath each longitudinal beam to support and move together with this and has at least one perpendicular side surface which extends continuously over the entire length of the support structure and faces the adjacent longitudinal beam of the support structure. In order to gas-tightly seal the furnace at its base for thermic reasons in order to prevent the flowing in of cold outside air into the furnace space, water troughs not movable together with the support structure and which extend over the entire length of the support structure are usually provided in known furnaces between two respectively adjacent support structures, wherein dip skirts which are arranged on the neighbouring support structures and movable together with these are immersed in the water filling of the water troughs. On account of the relatively large furnace length and the consequently resulting large length of the sub-structures for the longitudinal beams, the water troughs in known furnaces are assembled for constructive reasons out of individual longitudinal channels provided at their abutting end faces with outwardly projecting flanges which are bolted together with the intermediate arrangement of sealing strips in order to achieve a secure and liquid-tight joint of the abutting longitudinal channels.

In view of the fact that the individual parts to be treated in the furnace must be supported on at least two longitudinal beams per beam group and that metal sheet-like individual parts should not or only slightly laterally project outwardly at their edges over the displaceable beams supporting the parts for reasons of support, a center-to-center spacing between the adjacent displaceable beams of both beam groups which is as small as possible is desired. On account of the structurally necessary minimum cross-sectional dimensions of the water troughs and dip skirts as well as the support structures located at approximately the same height, it was not possible in previously known furnaces to realize a center-to-center spacing of less than 400 mm so that previously, the transport of thin metal sheeting caused great problems on account of the prevailing risk of too great a lateral projection beyond the edge.

It is therefore the object of the invention in a furnace of the type initially mentioned to reduce the center-to-center spacing of the longitudinal beams without endangering the effectiveness of the gas-tight sealing of the base. This is achieved in accordance with the invention in that a tube also extending over the entire length of the support structures is provided in this furnace between two adjacent support structures, the tube tightly engages the perpendicular side surfaces of at least one of the neighbouring support structures. The tube can be expanded in cross section by means of filling with a pneumatic or hydraulic pressurized substance and thus be pressed against the said side surface in such a manner that a good seal against the air flowing into the inner furnace space results at the base over the entire furnace length of the furnace.

In a preferred embodiment of the invention, the tube is supported on one of both of the neighbouring support structures, and in fact on consoles arranged on these support structures, the tube pressing with one of its sides against the perpendicular side surface of this support structure and with its other side against the perpendicular side surface of the neighbouring support structure. However, another embodiment is conceivable in which the tubes located between two respective support structures are not respectively supported on one of both of these support structures, but are rather individually arranged to be stationary between both support structures. The relative movement between the tube and the moving perpendicular side surfaces against which the tube is pressed during operation of the transport apparatus results through friction to the occurance of a longitudinal tenside stress in the tube. In order to reduce this disadvantage, it can be recommendable not to allow the tube to lie directly against the perpendicular side surface of the moving support structure, but rather via a sliding skirt which is arranged on its side facing this side surface.

The occurance of longitudinal tensile stresses in the tube is completely prevented in a particularly advantageous embodiment of the inventive furnace in that a rocker extending over the entire tube length is positioned on the side of the tube facing the perpendicular side surface of the adjacent support structure, the rocker being pivotable below and above the tube about an axis aligned with the transport direction of the furnace and pivotable against the said side surface by the inner pressure of the tube. This rocker can be forced either directly or via a sliding skirt arranged thereon tightly against the opposing support structure by means of the tube inner pressure.

In order to provide the furnace space such that it is not only gas-tight but that it heat-insulates well, the heat-insulating base located beneath the longitudinal beams in known furnaces of the type initially mentioned consist of a number of base parts located adjacent one another in an arrangement perpendicular to the transport direction of the furnace, each base part being arranged beneath one of the longitudinal beams and being carried by its support structure. In the known furnaces, the base parts usually consist of a hard material, for example ceramic material, on account of which they must be arranged at a slight distance from one another in view of the resulting continuous relative movement between two neighbouring base parts during the operation of the transport apparatus. However, this distance reduces the insulating effect of the base. In order to eliminate this disadvantage as well as to guarantee a continued gas-tight seal of the base with respect to the inner furnace space, the base parts can be respectively formed accordance with the invention of several layers of heat-insulating fiber mats in which lie substantially against one another with their side edges.

This abutting of the fiber mats of two adjacent base parts can lead to a certain abrasion at the touching mat edges. However, the gap arising between the adjacent base parts will always be limited to a minimum and is in any case substantially smaller than the gap which must be provided with base parts consisting of hard material.

This inventive advantage is also achieved if a perpendicularly standing supporting wall is provided at one side wall of the support structure for reasons of better supporting or protecting the fiber mats, the supporting wall being arranged on the support structure for the fiber mats of its base part.

Figure 2:
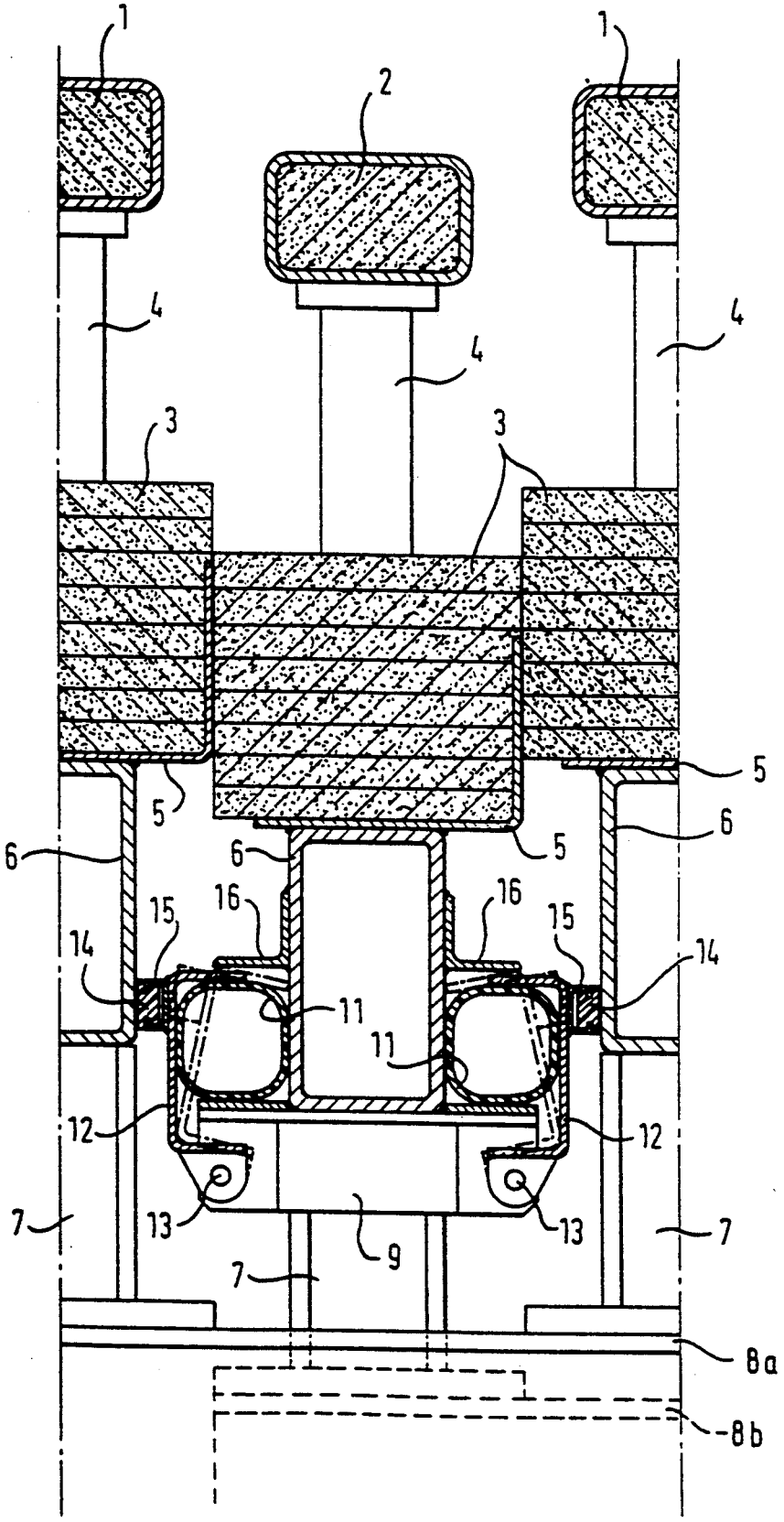

A particularly advantageous exemplified embodiment of the inventive furnace described in more detail in the following is shown in the drawings, in which:

FIG. 1 shows a cross section through the lower part of the furnace in a simplified view, and FIG. 2 shows a section of the cross section according to FIG. 1 on a larger scale.

The double walking beam furnace shown in the drawing has two groups of neighbouring longitudinal beams 1, 2 as seen in the cross section of the furnace, the beams of both of these groups lying alternatively adjacent one another in spaced relationship. These longitudinal beams 1, 2 are respectively carried by stays 4 of support structures, the main part of which consists of hollow box-type support beams 6 which are connected via stays 7 with transverse beams 8*a* and 8*b* movable to and fro and up and down via a drive mechanism in the longitudinal direction of the furnace.

Base parts 3 securely connected and movable with the support beams are seated directly on the support beams 6 and together form the hearth space of the furnace. These space parts 3 respectively consist of a number of superimposed fiber mats which are supported on a semi support part 5. This support part 5 consists of a base plate, upon which the fiber mats are supported, which is secured to the upper side of the support beam, and of a side wall which does not reach up to the uppermost fiber mat at a side edge of this base plate. The neighbouring base parts lie directly against one another via their fiber mats and the raised side wall such that a good insulating effect and, additionally, a substantially gas-tight seal of the hearth base of the furnace is ensured.

Each second longitudinal beam has consoles 9 on its support structure which project to both sides of the support beam 6 and carry tubes 11 lying at both sides of this beam, the tubes extending over the entire beam length. These tubes lie against the perpendicular side surfaces of the support beams with their side facing the support beams 6, while a rocker 12 respectively lies against their other side surfaces, the rocker also extending over the entire beam length and being pivotable about an axis 13 extending in the longitudinal direction of the tube. These rockers carry slide skirts 14 on their side opposite the tube, the slide skirts being supported in fixtures 15 and being pressable against the vertical sides of the adjacent support beams 6 with their flat side surfaces. This pressing of the slide skirts 14 ensues by means of expansion of the tubes 11 with the aid of a pneumatic or hydraulic pressurized substance filled into the tubes. The slide skirts usefully consist of an abrasive-free material with a smooth upper surface, for example hard plastic.

The rockers engage partially over the tubes 11 with their upper side facing away from the pivot axis 13 in order to protect these from above against the heat and hot chippings or the like which may fall from above. For the same purpose, angular sections 16 are arranged at the side surfaces of the support beams 6.

It is also possible that each longitudinal beam is provided with projecting consoles on one side thereof having tubes or the like.

What is claimed is:

1. A furnace for the heat treatment of individual parts, for example metal sheeting, comprising a transport apparatus for conveying the parts to be heated through the furnace, the transport apparatus having two groups of longitudinal beams carrying the parts which are alternatively arranged in spaced relationship to one another and at least one of these beam groups being movable forwardly into a higher position than the other beam group over a partial stretch of the transport route through the furnace and being subsequently movable back into its initial position into a lower position than the other beam group, and a support structure being provided beneath each longitudinal beam to support and move together with this and having at least one perpendicular side surface which extends continuously over the entire length of the support structure and faces the longitudinal beam of the adjacent support structure, characterized in that a tube is provided between two adjacent support structures which also extends over the entire length of the support structures and tightly engages the said side surfaces.

2. A furnace according to claim 1, characterized in that the tube is expandable in cross section through filling with a pneumatic or hydraulic pressurized substance and thus pressable against the said side surface.

3. A furnace according to claim 1, characterized in that the tube is supported on one of both neighbouring support structures.

4. A furnace according to claim 3, characterized in that the tube is supported on one or more consoles which are provided on the support structure.

5. A furnace according to claim 4, characterized in that the support structure of every second longitudinal beam carries two sealing tubes which engage the facing perpendicular side surfaces of both adjacent support structures.

6. A furnace according to claim 1, characterized in that the tube carries a slide skirt on its side facing the said perpendicular side surface, the slide skirt extending over the entire length of the tube and being pressable against the said side surface by the tube.

7. A furnace according to claim 6, characterized in that a rocker extending over the entire tube length is arranged on the side facing the said perpendicular side surface, the rocker being pivotable below and above the tube about an axis extending in the transport direction of the furnace and being pivotable against the side surface by means of the inner pressure of the tube.

8. A furnace according to claim 7, characterized in that a slide skirt extending over the entire rocker length is positioned on the side of the rocker facing the said perpendicular side surface.

9. A furnace according to claim 6 or 8, characterized in that the slide skirt has a smooth sliding surface.

10. A furnace, in particular according to claim 1, heat-insulating base of which located beneath the longitudinal beams consists of a plurality of base parts located adjacent one another in perpendicular arrangement to the transport direction of the furnace, each base part of the base being arranged beneath one of the longitudinal beams and being supported by means of its support structure, characterized in that the base parts are respectively formed of several layers of heat-insulating fiber mats which lie substantially against one another with their side edges.

11. A furnace according to claim 10, characterized in that the fiber mats lie on a support surface which is secured to the support structure in the upper region thereof and has a side wall extending upwardly at least over a part of the total height of the mat layers, the fiber mats of the adjacent base parts lying substantially against this side wall.

* * * * *